United States Patent [19]

Snow

[11] 4,140,137

[45] Feb. 20, 1979

[54] ADJUSTABLE APERTURE CIGARETTE PERFORATING APPARATUS

[75] Inventor: Harland J. Snow, Richmond, Va.

[73] Assignee: Philip Morris Incorporated, New York, N.Y.

[21] Appl. No.: 804,416

[22] Filed: Jun. 7, 1977

[51] Int. Cl.[2] ..... A24C 5/30; A24F 13/24

[52] U.S. Cl. ..... 131/23 R; 131/254

[58] Field of Search ..... 131/233, 23 R, 170, 131/83 R, 253, 254; 83/2, 30, 660, 623; 100/94–96

[56] References Cited

U.S. PATENT DOCUMENTS

| | | | |
|---|---|---|---|
| 3,483,873 | 12/1969 | Hinzmann | 131/23 R |
| 3,701,353 | 10/1972 | Paquine et al. | 131/23 R |
| 4,061,148 | 12/1977 | Goslin et al. | 131/23 R |

*Primary Examiner*—Stephen C. Pellegrino

*Attorney, Agent, or Firm*—Arthur I. Palmer, Jr.; George E. Inskeep; Susan A. Hutcheson

[57] ABSTRACT

A cigarette perforating mechanism which operates to perforate a cigarette after the filter final assembly in a cigarette making machine. Perforating points of V design are mounted adjustably so that the points may be set to different heights to make perforations of different size thereby to obtain better control of the depth and width of point penetration. The points are arranged on an arc and are made integral in a thin strip of sheet metal which is fixed in a rolling shoe. A rolling drum rolls the cigarettes over the shoe and the height-adjusted points to perforate the cigarette with holes to a preselected depth and width assembly depending on the preselected depth to which the V-shaped perforating points are driven into the cigarette.

3 Claims, 6 Drawing Figures

ADJUSTABLE APERTURE CIGARETTE PERFORATING APPARATUS

BACKGROUND OF THE INVENTION

In the manufacture of vented filter tip cigarettes, it is know to position a double filter section in alignment with and between a pair of tobacco rod sections and to then adhesively attach to the assembly at the midsection, a tipping paper section, the assembly being carried around a drum past an arc-shaped shoe positioned adjacent to but spaced from the periphery of the drum in such manner that the unit is given a rolling action which wraps the tipping paper about the filter section and an overlapping connection at each side onto the respective cigarette rod sections. The assembly is then cut through at its midpoint resulting to provide a pair of filter tipped cigarettes.

Where a vented cigarette is desired, the assembly during the wrapping operation is brought into contact with needles which puncture venting holes in the wrapper. In one type of apparatus as disclosed in U.S. Pat. No. 3,701,353, a section of the assembly is rolled past a row of needle points appropriately located in the rolling shoe to provide a peripheral row of venting holes near the ultimate mouth end of the cigarette, i.e., in the filter of the respective cigarette structures, the perforating means comprising a series of pointed needles formed integrally in a strip member carried in the rolling shoe.

SUMMARY OF THE INVENTION

The present invention is an improvement of the perforating apparatus disclosed in U.S. Pat. No. 3,701,353. The perforating needles are as in said patent, provided as integral structure of a thin flat strip which has one edge appropriately ground to form the row of needles of inverted V configuration. The number of strips employed will of course depend upon the rows of perforations desired. In accordance with the present invention, the needle strip is mounted in the apparatus adjustably to allow for preselection of the height of protrusion of the points in a block positioned in the surface of the rolling shoe. Thus the depth and width of the needle point penetration can be more readily controlled thereby to provide for varying the ventilation characteristics of the cigarettes over a wide range of desired values.

The invention further contemplates structural features of advantage in supporting and securing the strips adjustably as to the height of the V teeth in proper position in the rolling shoe and in relation to the cigarette drum carrier.

Other features and advantages will be made apparent from a consideration of a representative embodiment as described hereinafter and shown in the drawings.

DESCRIPTION OF THE PREFERRED EMBODIMENT

Figure 1:
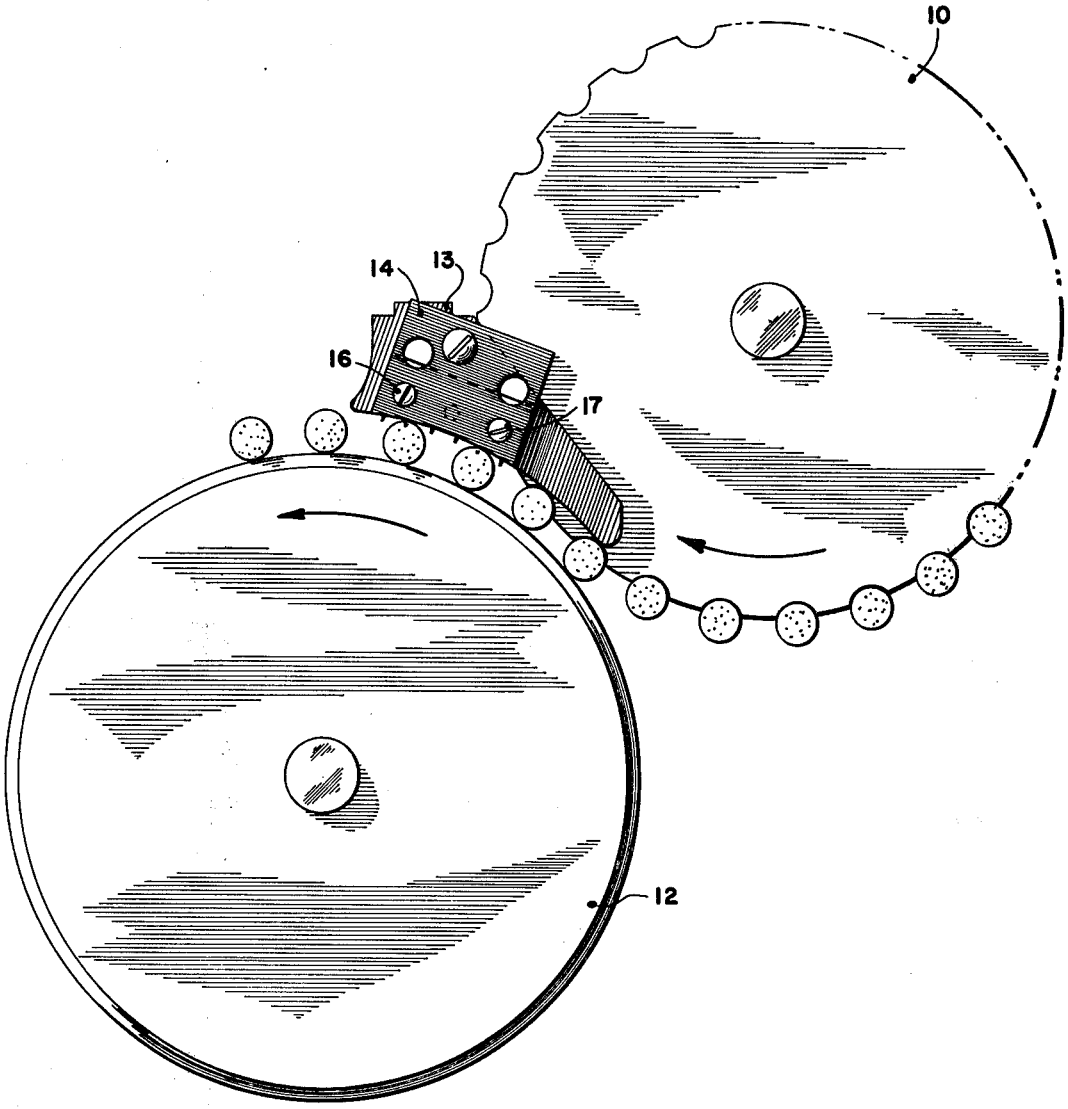
FIG. 1 is a fragmentary showing of a cigarette assembling machine embodying a rolling shoe and improved perforating means of the character comprising the present invention.

In FIG. 1, there are shown parts of a machine of the general type adapted to embody the improved perforating means of the present invention. In its general features, it is like that disclosed in the Hinzmann U.S. Pat. No. 3,527,234. Further disclosure is contained in U.S. Pat. No. 3,701,353 to Arthur R. Pasquine, Harland J. Snow, and Edward E. Wagner which is incorporated herein and made a part hereof, the present invention being an improvement of the machine disclosed in said Pasquine et al patent.

In the improved machine of the present invention, two cigarette tobacco rod sections and an intervening double filter length are brought into end-to-end abutting relation with a tipping wrap applied joining the two tobacco rod sections and the intervening filter rod section. Normally, the filter rod section will have had applied previously thereto a wrapper shown broken away in FIG. 1A. Concurrently with the rolling of the tipping paper about the double unit and in the same operation of the present machine, two peripheral rows of perforations may be made through the tipping paper and the filter rod wrapper. Subsequently, the cut is made across the unit severing it into two independent cigarettes. In the presently preferred embodiment of the invention, the cigarettes are advanced as separate units and are perforated after separation.

In the machines disclosed in the above cited two patents, units comprising an assembly of the two tobacco rod sections and the intervening filter rod section without the tipping paper are inserted in successive peripheral grooves of a transfer drum. A continuous strip of tipping paper is fed onto an anvil drum and the outer surface of the strip at the drum carries an adhesive glue layer. A starshaped cutter separates the tipping paper strip into sections and such sections are caused to adhere to each of the cigarette units on a transfer drum and are carried around past an enclosing shroud to where they are transferred to grooves in a rolling drum being held therein by suitable suction means. The units are carried on the drum in a counterclockwise direction to where they are brought under a rolling shoe fixed on the frame, the suction at this area being released from the cigarette units. Underneath the shoe, the cigarettes leave their respective grooves in the rolling drum and are given a rolling action underneath the shoe which wraps the tipping paper around the double unit.

As shown in FIG. 1, attached adjacent the transfer drum 10 and rolling drum 12, the rolling shoe 13 embodies the perforating means which will now be described as being adapted to perforate single cigarette units. This comprises a block 14 set against the face of the rolling shoe 13. The surfaces of the rolling shoe 13 and of the block 14 facing the rolling drum 12 have a concave cylindrical shape with a radius about the axis of the rolling drum 12, the surface of the block 14 merging with that of the rolling shoe 13.

Figure 1A:
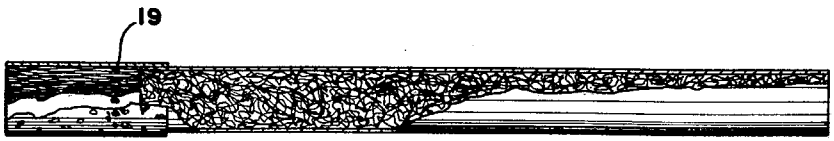
FIG. 1A is a view of a perforated cigarette made by the apparatus of the present invention.
Figure 2:
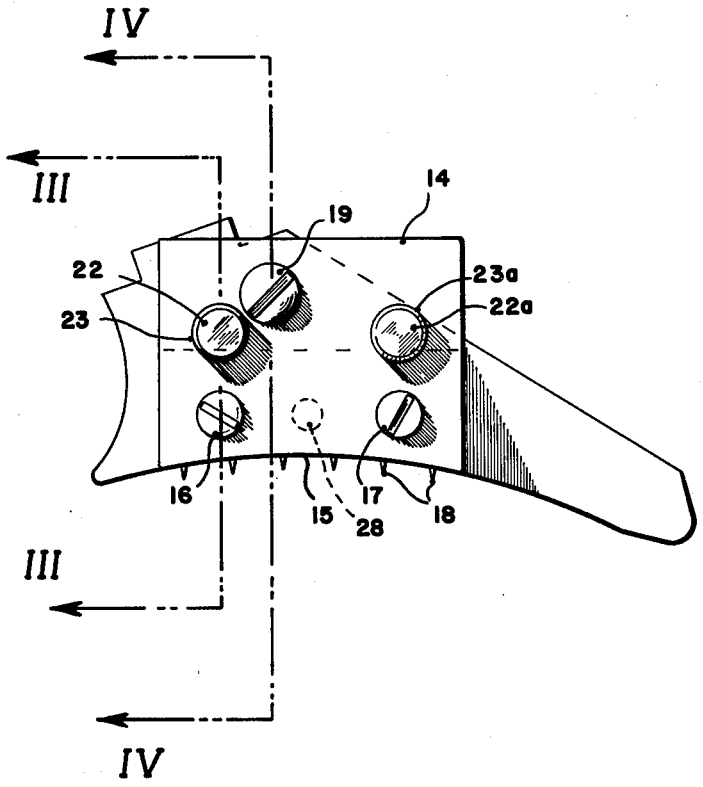
FIG. 2 is a view of the insert block embodying the perforating means showing it positioned on the rolling shoe.

Secured in the block 14 is a perforating strip 15 locked in place by holding screws 16 and 17 as indicated in FIG. 2. The strip 15 is provided with needle points 18 which are laterally spaced suitably to form a row of perforations 19 in each of the individual cigarettes as shown in FIG. 1A. The block 13 is so positioned that the needle points 18 of the strip 15 extend in the direction of peripheral movement of the surface of the rolling drum 12 so as to form a row of perforations extending peripherally of the cigarette. More strips may readily be employed if more rows of perforations are desired, as for example, two rows in each cigarette.

Figure 5:
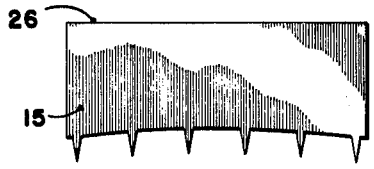
FIG. 5 is a plan view of a perforating strip.
Figure 4:
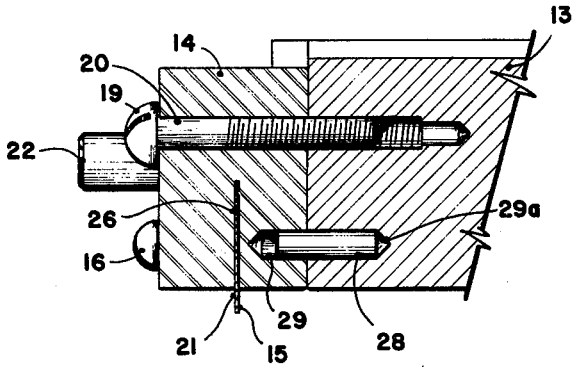
FIG. 4 is a fragmentary sectional view taken on the plane IV—IV of FIG. 2.
Figure 3:
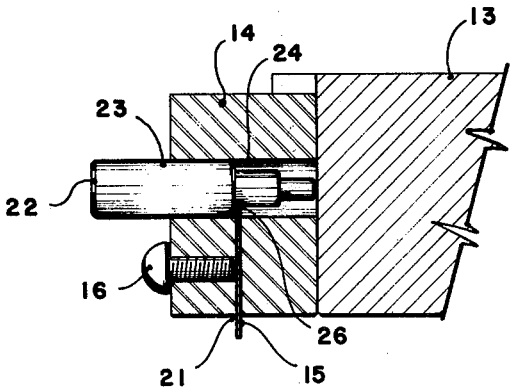
FIG. 3 is a transverse sectional view taken on the plane III—III of FIG. 2.

Different materials may be selected for the strip 15. Pretreated spring steel stock has been found especially useful. The hardness is carefully controlled and made uniform to the extreme points of the needles 18. The strips are ground at one edge to form the row of needles 18, the grinding operation being so applied as to result in the needle points 18 being arranged on an arc corresponding to the inner face of the rolling shoe 12 and the block 13. In the present instance, the strip 15 has six needle points resulting in a corresponding number of perforations in the periphery of the cigarette. Conveniently, and as disclosed in U.S. Pat. No. 3,701,353, the strip 15 can be gang ground in a stack. The grinding operation may be varied readily to produce different angles in the desired shaped individual needles in the form of an inverted V as shown in FIG. 5. Since the strip 15 is of a uniform thickness, the V-shaped needles assure perforations of preselected size when set to a given depth. Further to the foregoing, the thickness of the strips 15 may, of course, be varied depending upon the circumstances including particularly the range of sizes of perforation desired. Normally, the thickness of the strip should be less than about 0.015 of an inch, but more commonly, thinner than that, and as a specific example, in the range of about 0.008 of an inch in thickness. It will be understood that the dimensions shown in FIGS. 3 and 4 are somewhat exaggerated in the interest of clarity. The block 14 is secured to the shoe 13 by a screw 19 extending through opening 20 in the block 14, and maintained in proper alignment by pilot pin 28.

The strip 15 is mounted in slot 21 in block 14 to adjustably position the points 18 to selective heights in the block 14 in the following manner. Height gauges 22 and **22*a* are temporarily placed in the gauge holes 23 and 23*a* in the block 14 so as to locate the positioning land 24 of gauge 22 and a similar positioning land on gauge 22*a* in a location to intercept and act as a stop for the upper edge 26 of the needle strip 15. The strip 15 is inserted in the slot 21 and urged upwardly therein until the upper edge 26 comes in contact with the positioning lands of gauges 22 and 22*a*. Then the locking screws 16 and 17 are tightened to lock the strip 15 in the selected height position with the points 18 protruding at a desired distance outwardly of the lower surface of the block 14. A pilot pin 28 is received in openings 29 and 29*a* and extends between the block 14 and the rolling shoe 13** to provide precise alignment therebetween.

Thus, the height of the points 18 may be selectively set by utilizing a series of pairs of height gauges made with positioning lands of different diameter. These may be utilized to reset and lock the strip 15 in any one of desired preselected heights. With the needle tip ends or points thus capable of being adjustably positioned, the depth and width of the perforations made therewith can be altered to produce desired alterations in the ventilation characteristics of the cigarettes.

What is claimed is:

1. In a cigarette handling machine including a cigarette rod rolling member, a cigarette rod carrier relatively movable adjacent thereto and appropriately spaced to produce a rolling of the cigarette rod along a surface of the member, and perforating means comrpising a strip removably and replaceably mounted adjacent the surface of said member, said strip having integral therewith a row of needles aligned in the direction of said relative movement positioned to pierce and form a peripheral row of apertures in the cigarette rod, the improvement of mounting means for selectively positioning the tip ends of said needles relative to the surface of said member, said mounting means including a block structure carried on said rolling member and having a slot therein, said strip being received in said slot, said block structure further having a passage extending therethrough and communicating with said slot, a gauge member removably receivable in said passage and having a positioning land thereon locating in said slot against which said strip abuts for effecting a selective positioning of said needle tip ends relative to the surface of said member, and means carried in said block structure and engageable with said strip for locking the position of said strip in said slot.

2. A cigarette handling machine in accordance with claim 1 in which the locking means carried in said block comprise locking screws.

3. A cigarette handling machine in accordance with claim 1 in which said block structure is provided with a second passage extending therethrough and communicating with said slot, there being a further strip gauge member associated with and removably receivable in said second passage.

* * * * *